US006000750A

United States Patent [19]

Rossman et al.

[11] Patent Number: 6,000,750

[45] **Date of Patent: *Dec. 14, 1999**

[54] CONVERTIBLE PLAY CENTER FOR CHILDREN

[75] Inventors: Jon R. Rossman, Chelmsford; Bryan R. Hotaling, Arlington, both of Mass.

[73] Assignee: The First Years Inc., Avon, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/751,080

[22] Filed: Oct. 25, 1996

[51] Int. Cl.[6] ..... A47C 13/00; A47D 1/08

[52] U.S. Cl. ..... 297/2; 297/3; 297/118; 297/119; 297/136; 297/247; 297/270.1; 297/344.18; 108/11; 108/144; 108/12; 108/25

[58] Field of Search ..... 297/2, 3, 118, 297/119, 129, 136, 344.18, 344.12, 258.1, 260.1, 272.1, 270.1; 108/11, 12, 14, 144, 25, 26; 312/194, 195, 237, 277, 293.1; 248/188.2, 188.5

[56] References Cited

U.S. PATENT DOCUMENTS

| | | | |
|---|---|---|---|
| 1,412,723 | 4/1922 | Toal | 297/247 X |
| 1,674,741 | 6/1928 | Rosman | 297/247 X |
| 1,856,687 | 5/1932 | Baker | 297/2 |
| 2,037,634 | 4/1936 | Klaskin | 297/344.18 X |
| 2,225,723 | 12/1940 | Spitzwieser | 297/247 X |
| 2,269,834 | 1/1942 | Wagner | 297/270.1 X |
| 2,362,685 | 11/1944 | Damsted | 297/247 X |
| 2,417,618 | 3/1947 | Scott | 297/247 X |
| 2,440,979 | 5/1948 | Schneider | 297/119 |
| 2,510,199 | 6/1950 | Schladermundt | 297/270.1 X |
| 2,672,181 | 3/1954 | Rose | 297/119 |
| 2,705,524 | 4/1955 | Shipman . | |
| 3,003,543 | 10/1961 | Duncan | 297/136 X |
| 3,556,586 | 1/1971 | Beardmore | 297/3 |
| 3,558,186 | 1/1971 | Shore et al. | 297/136 |
| 3,592,506 | 7/1971 | Breslow | 297/118 X |
| 4,205,876 | 6/1980 | Cetina | 297/3 X |
| 5,054,851 | 10/1991 | Chiu | 297/136 |
| 5,107,775 | 4/1992 | Langlais | 108/144 |
| 5,230,523 | 7/1993 | Wilhelm | 297/3 X |
| 5,415,454 | 5/1995 | Fu-Tsung | 297/3 |
| 5,584,531 | 12/1996 | Bowman | 297/136 X |
| 5,690,379 | 11/1997 | Cayssials | 297/118 |

FOREIGN PATENT DOCUMENTS

| | | | |
|---|---|---|---|
| 163012 | 5/1949 | Austria | 297/270.1 |
| 337170 | 3/1904 | France | 297/270.1 |
| 2719761 | 11/1978 | Germany | 297/258.1 |
| 8844 | 8/1894 | Switzerland | 297/270.1 |
| 8402835 | 8/1984 | WIPO | 108/11 |

OTHER PUBLICATIONS

"Phases high chair grows up with your baby" Evenflo one–page advertisement.

*Primary Examiner*—Peter M. Cuomo
*Assistant Examiner*—Rodney B. White
*Attorney, Agent, or Firm*—Fish & Richardson P.C.

[57] ABSTRACT

Convertible furniture for children for use in different configurations as either a table or child's seat. The furniture comprises a base, vertical supports, and a removable top. The top includes a rotating fabric sling seat for very young children. With the top removed, the furniture may be inverted for use as a play table. Rockers, rocker locks and means to prevent seat rotation are also disclosed. The vertical supports are telescopically extendable to adjust the height of the furniture.

16 Claims, 10 Drawing Sheets

CONVERTIBLE PLAY CENTER FOR CHILDREN

BACKGROUND OF THE INVENTION

This invention relates generally to children's furniture, and particularly to a piece of furniture convertible for several uses.

As children grow and develop over the first several years of their lives, their needs change. Particular to this invention, it is desirable to have a single piece of furniture that can be adaptable to meet their changing size and abilities.

During the early stages of their development, it is customary to place small children in flexible seats suspended from a frame, or in high-chairs when eating. As they develop the ability to support their own weight and sit erect, it is common to place them at small tables, either for eating or playing. The cost of purchasing several different articles of furniture, as well as the space they consume, can be burdensome.

SUMMARY OF THE INVENTION

In one aspect of the invention, convertible children's furniture is provided, the furniture comprising a base, spaced apart supports connected to and extending upwardly from the base, and a top extending between and removably connected to and supported in spaced relation to the base by the supports. The outwardly facing portions of the base and the top are configured to have differing functions, so that upon removal of said top, the furniture can be inverted to permit the use of the outwardly facing portion of the base.

Preferred embodiments of the invention include one or more of the following features: the top includes a child's seat; the child's seat comprises a frame and a flexible sling with a pair of holes to accept a child's legs, the sling being connected to the frame; the sling is removably connected to the frame; the frame is rotatably mounted to the top; the top further comprises a lock to alternatively prohibit rotation of the frame within the top; the lock comprises a slidable member of the frame, the slidable member constructed and arranged so as to engage at least one slot in an upstanding lip of the top; the top is resiliently connected to the supports; the supports are vertically adjustably mounted to the base to adjust the height of the furniture; the outwardly facing portion of the base comprises a flat portion for use as a table surface; at least one side extending between the supports is uninterrupted by structure extending away from the top beyond the flat portion; two curved rockers extend downwardly along opposing edges of the outer surface of the base to permit rocking; and engageable stops are included to disallow rocking motion of the furniture in a forward direction, a rearward direction, or in both directions.

The furniture of the invention can advantageously provide exercise and entertainment for small children, such as is typical of a mobile walker, but without some of the dangers associated with the mobility of walkers. The furniture can also be adapted to children's changing size and interests as they grow.

DESCRIPTION OF THE PREFERRED EMBODIMENTS

The figures illustrate the structure and assembly of a piece of children's furniture according to the invention.

Figure 1:
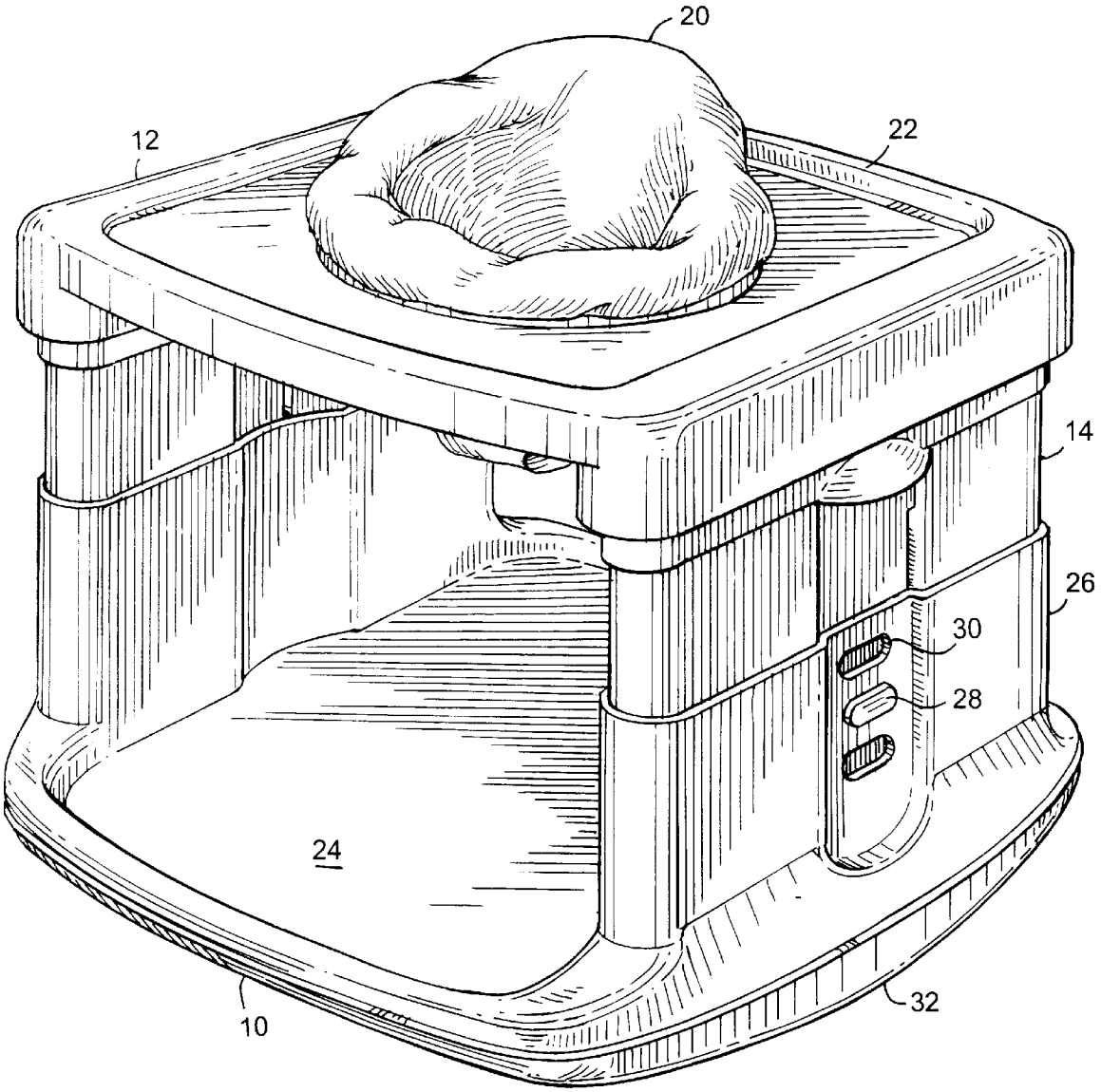
FIG. 1 is a perspective view of furniture according to the invention.

Referring first to FIG. 1, the furniture consists of three major sections: a base section 10, a top section 12, and connecting supports 14. When assembled in a first configuration as shown, the three sections together form a child's chair suitable for infants with a fabric sling 20 mounted on a rotatable frame disposed within a hole in top 12 such that when seated, the infant is effectively comfortably suspended from top 12. The outwardly facing upper surface of top 12 has a raised outer lip 22 to avoid spills and drips onto the floor. For larger infants, upper surface 24 of base 10 serves as a support for the feet of the child.

Supports 14 extend into raised support receivers 26 integrally molded with upper base surface 24. Two spring-biased buttons 28, one in each support 14, selectively engage holes 30 at various heights within receivers 26 to adjustably attach supports 14 to base 12. In this manner, the height of the furniture can be adjusted.

Figure 4:
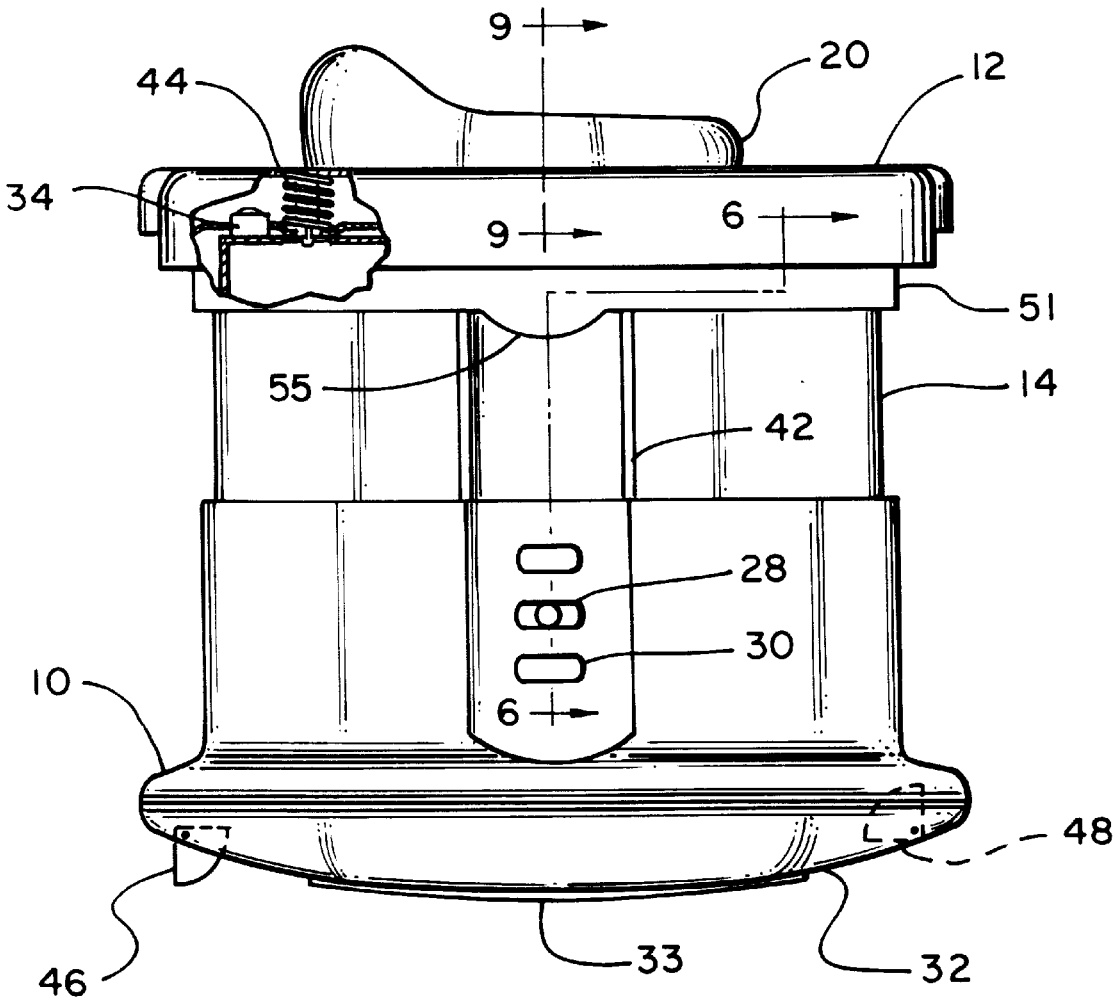
FIG. 4 is a side elevation of the furniture with a portion broken away.
Figure 7:
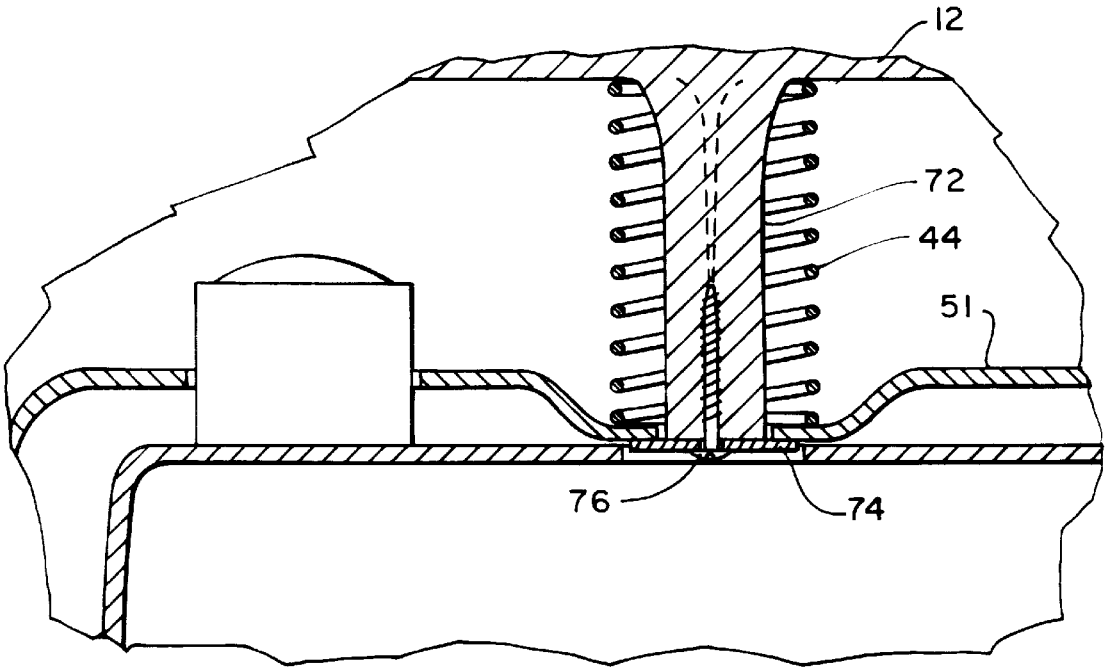
FIG. 7 is an enlarged sectional view of elements shown in the area broken away in FIG. 4.

As shown in FIGS. 4 and 7, supports 14 fit into top support sleeves 51, which are connected to top section 12 through four compression coil springs 44, one placed near each corner of top 12 to provide a resilient mount. Projections 34 at the top of supports 14 engage holes in sleeves 42 to assist in maintaining the location of top 12 with respect to base 10. Springs 44 are disposed around posts 72 and retained by washers 74 and fasteners 76.

Figure 2:
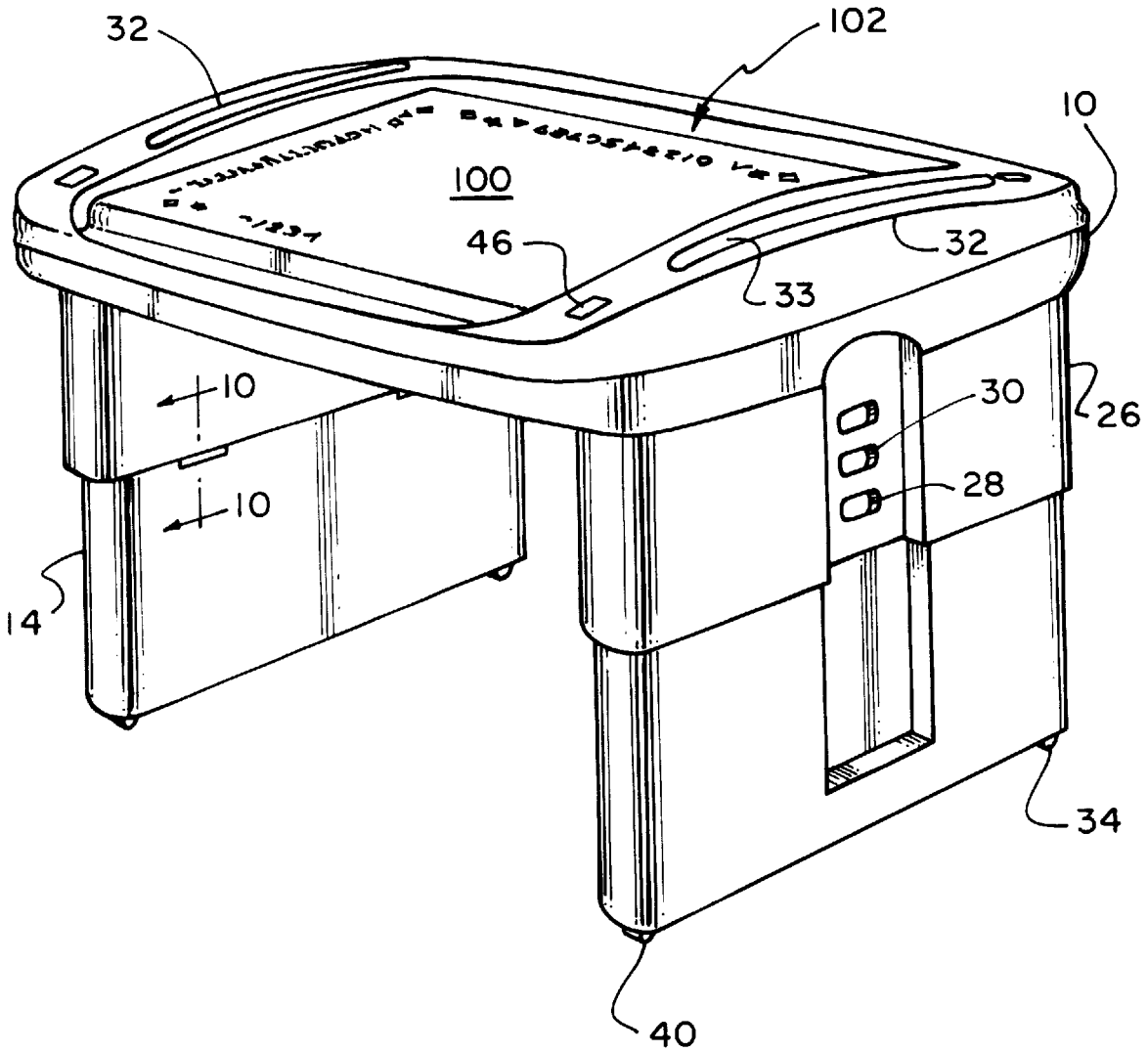
FIG. 2 is a perspective view of the furniture with the seat portion removed and the furniture inverted for use as a table.

For use with older children, top section 10 may be easily removed and the base 12 and supports 14 inverted, to form a child's table as shown in FIG. 2. The upper surface of the table includes a broad, flat area 100 bounded on two sides extending between the supports by integral, recessed pencil trays 102 uninterrupted along the two sides by any structure extending above the flat area 100. Rounded, resilient plastic caps 40 attached to integrally molded projections 34 on supports 14, at the lower end in this position, support the table against the floor. Buttons 28 may be easily moved between holes 30 to adjust the height of the table as desired, or when separating the supports from the base.

Figure 3:
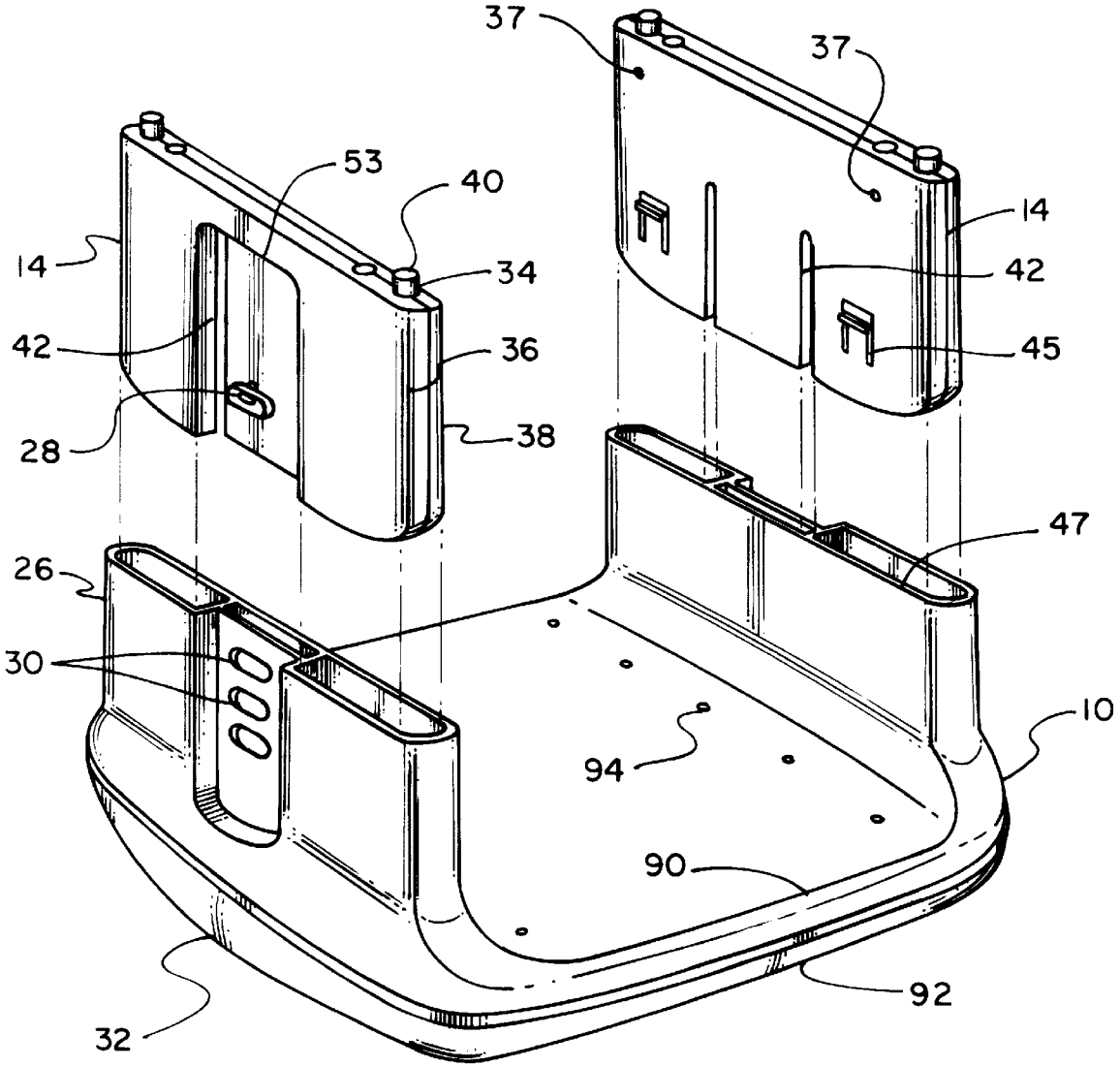
FIG. 3 is an exploded perspective view showing the assembly of the base and adjustable supports.
Figure 6:
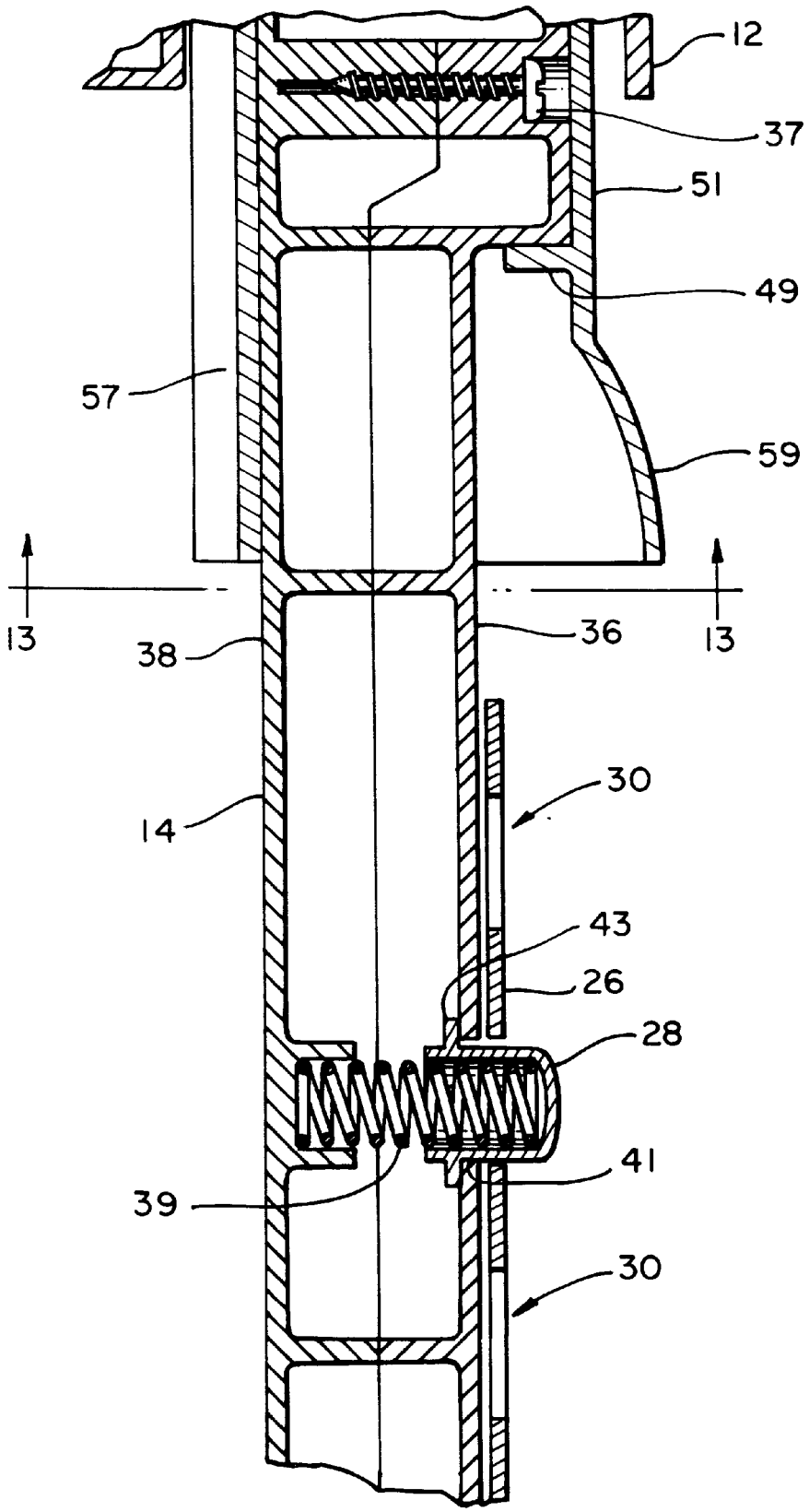
FIG. 6 is an enlarged cross-sectional view of one side of the furniture, taken along line 6—6 in FIG. 4.
Figure 13:
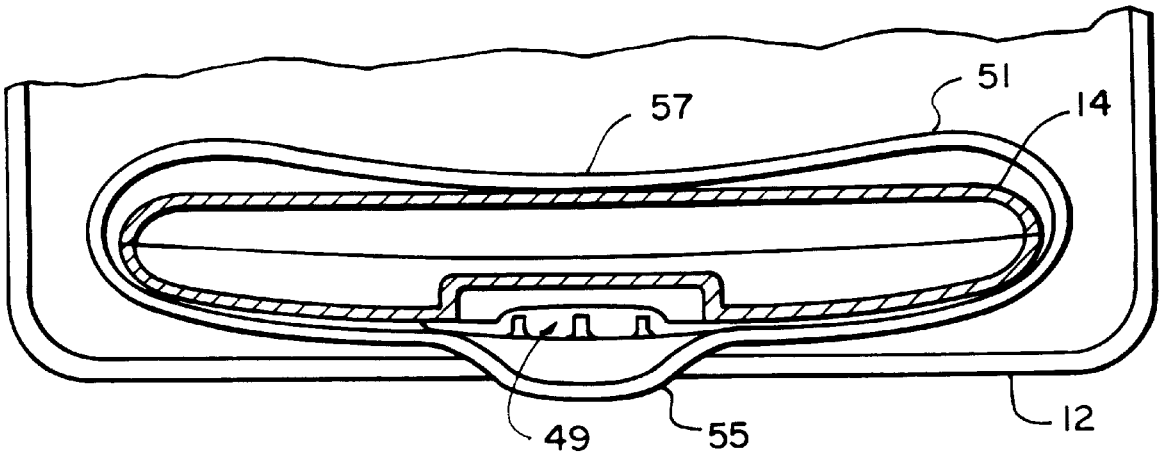
FIG. 13 is a fragmentary cross-sectional view taken along line 13—13 if FIG. 6.

FIGS. 3 and 6 illustrate more detail of supports 14, which comprise two injection molded halves 36 and 38 fastened together with self-tapping fasteners 37. Disposed between the two halves is a button spring 39 that biases button 28 in an outward direction. A portion of button 28 protrudes through a hole 41 in support half 36. A flange 43 on the inward edge of button 28 keeps the button confined within support 14. When top 12 is in place, an inner lip 49 on sleeve 51 engages ledge 53 on support half 36 to retain the top on the supports. An extended portion 55 of sleeve 51 serves as a handle to remove top 12 by disengaging lip 49 from ledge 53 when pulled outward. An outwardly bowed portion 57 of the inner side of sleeve 51 serves as a spring member to keep a retaining pressure against support half 38, as shown in FIG. 13.

Figure 10:
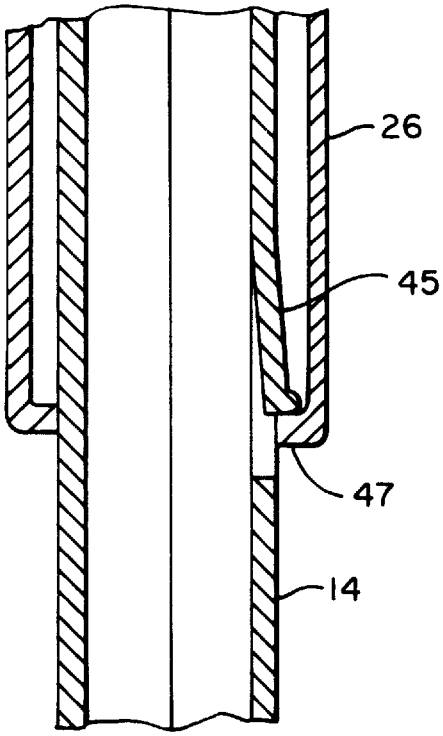
FIG. 10 is an enlarged cross-sectional view taken along line 10—10 in FIG. 2.

Receiver 26 of base 10 comprises three parallel sleeves that accept the three sections of support 14, the lower portions of which are separated by partial slots 42, as assembled. Together, support 14 and receiver 26 form a telescoping vertical member, with resilient fingers 45, integrally molded with support half 38, engaging an inner lip 47 to limit the extension of support 14 when button 28 is compressed, as shown in FIG. 10.

Figure 11:
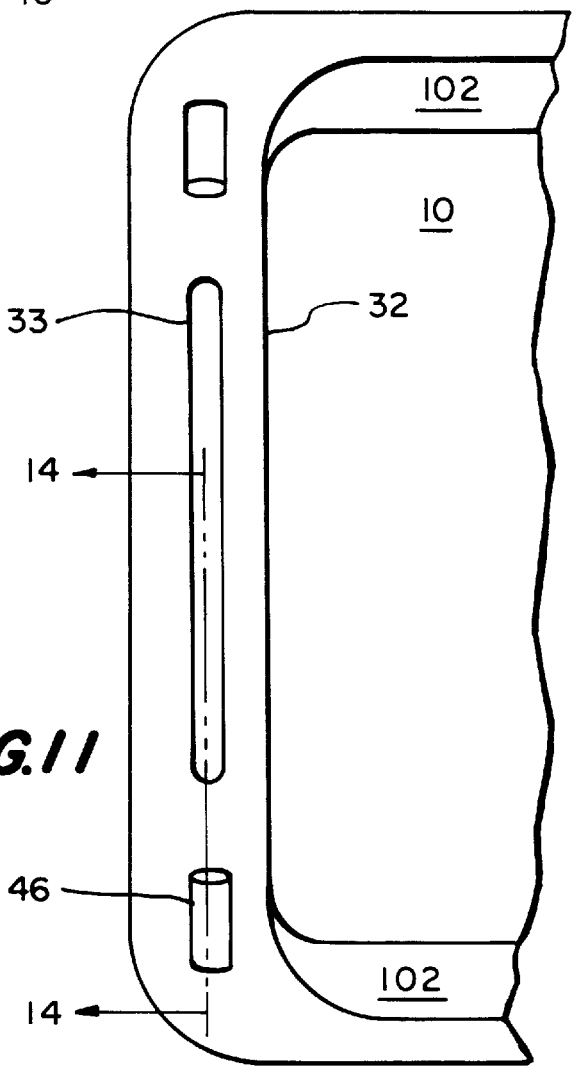
FIG. 11 is a partial bottom view of the furniture.
Figure 14:
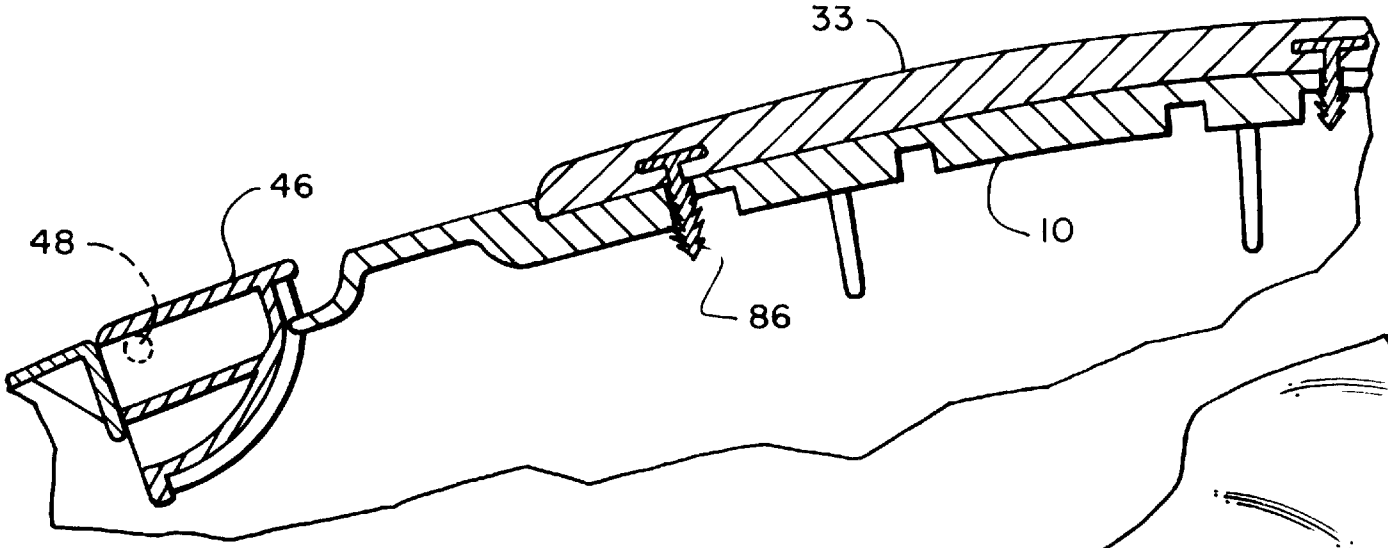
FIG. 14 is a fragmentary cross-sectional view of a rocker, taken along line 14—14 in FIG. 11.

Referring to FIGS. 4, 11 and 14, two curved rockers 32, along opposite edges of base 10, permit the furniture to be moved forward and backward in a rocking motion when configured as a seat. Rocker pads 33 are attached to the rockers with molded snap-type fasteners 86, providing a resilient contact surface with a floor. Rocker stops 46 are mounted to base 10 on integrally molded pivots 48 at either end of rockers 32. Recesses are provided in base 10 to accept rocker stops 46 when retracted. When engaged (extended), stops 46 contact the floor to prohibit the rocking motion of the furniture in a forward direction, a backward direction, or both directions.

The base 10 is constructed as an assembly of an upper half 90 comprising the receiver 26, and a lower half 92 comprising the rockers 32 and rocker stops 46. The two halves are held together by self-tapping fasteners 94, shown in FIG. 3.

Figure 5:
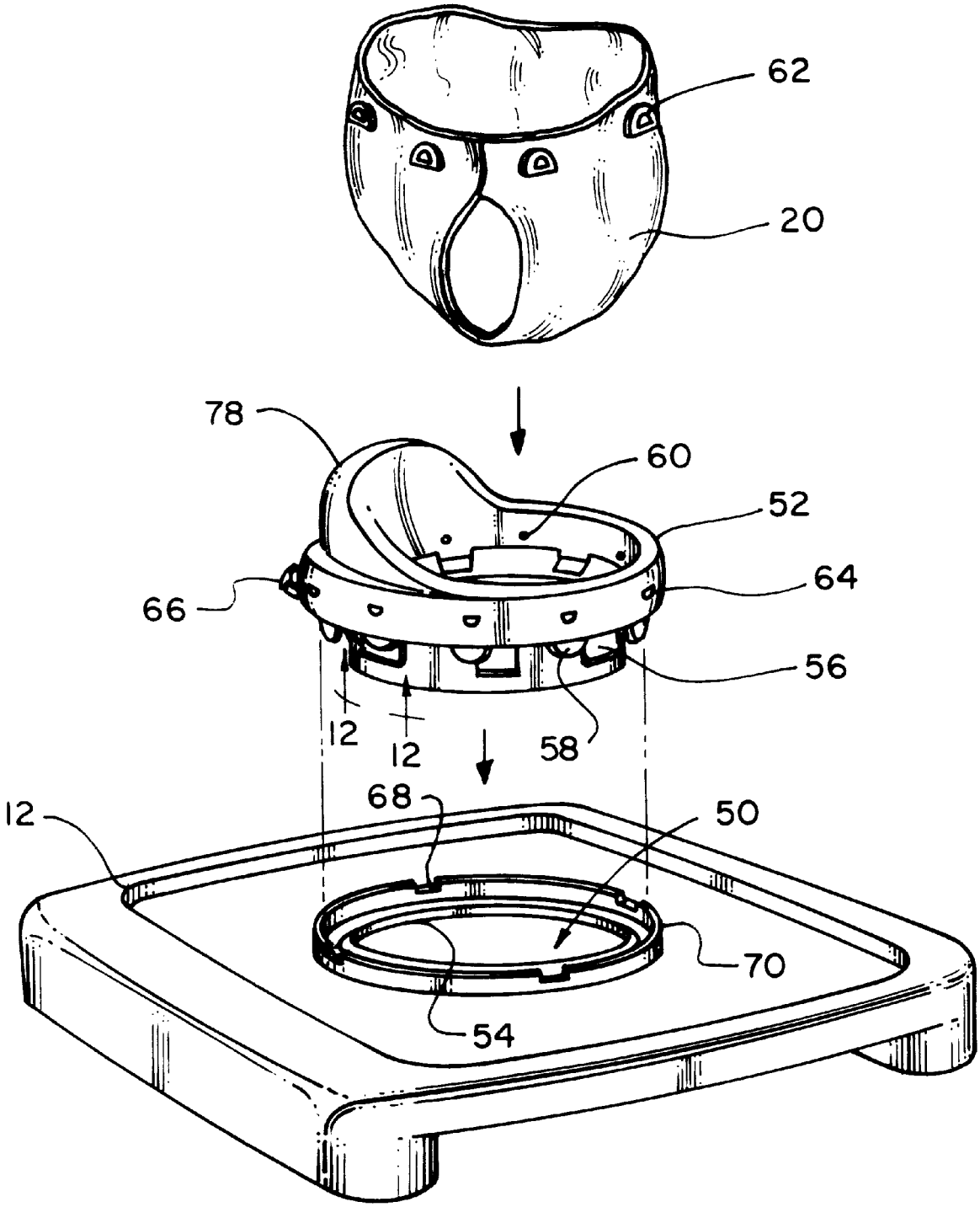
FIG. 5 is an exploded perspective view showing the details of a child's seat, according to the invention.
Figure 15:
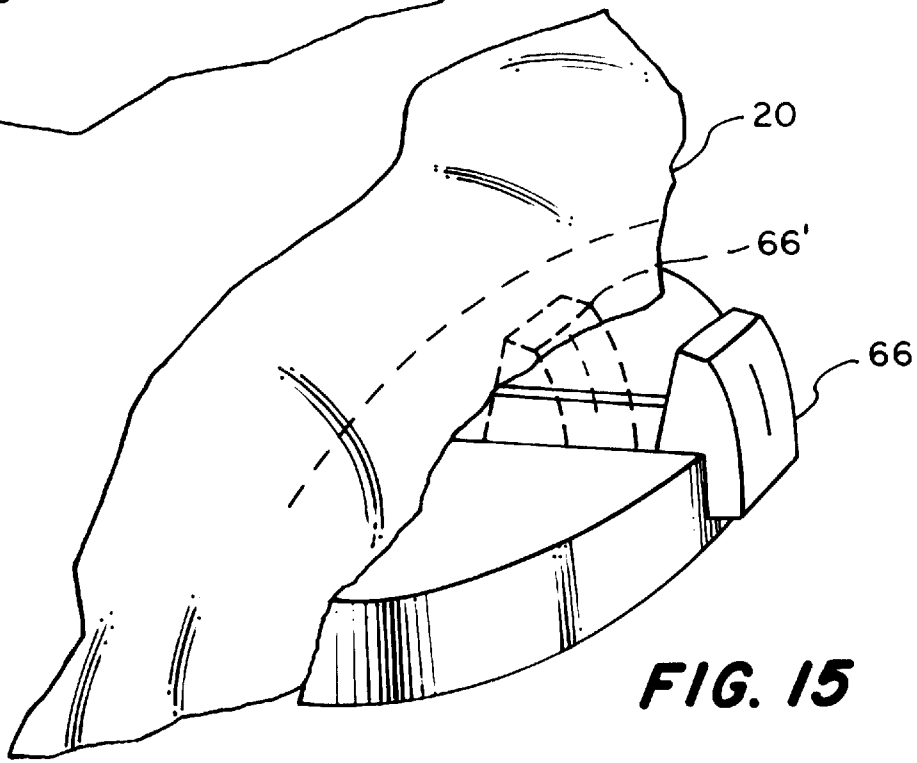
FIG. 15 is a perspective view of a seat lock.

FIG. 5 illustrates some details of the construction of top section 12. Hole 50 is provided in top 12 to accept a seat frame 52. A lip 54 on the lower edge of the inner surface of hole 50 is engaged by outwardly facing resilient flanges 56 integrally molded with frame 52 and keeps the frame in place. Flanges 56 snap outward about lip 54 to secure the frame to the top section. A lock 66 is provided on frame 52 to selectably secure frame 52 against rotation in a number of positions by engaging one of slots 68 in an upstanding lip 70 around hole 54 when the lock is moved inward to position 66' as shown in FIG. 15. When lock 66 is moved outward to a released position, the seat is free to swivel.

Figure 9:
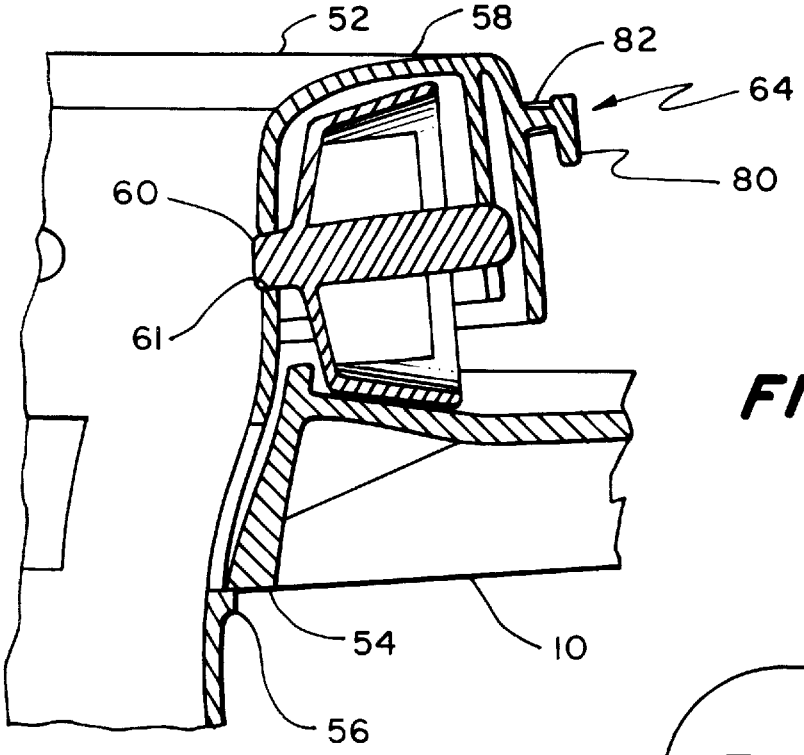
FIG. 9 is an enlarged cross-sectional view of one side of the seat frame, taken along line 9—9 in FIG. 4.
Figure 12:
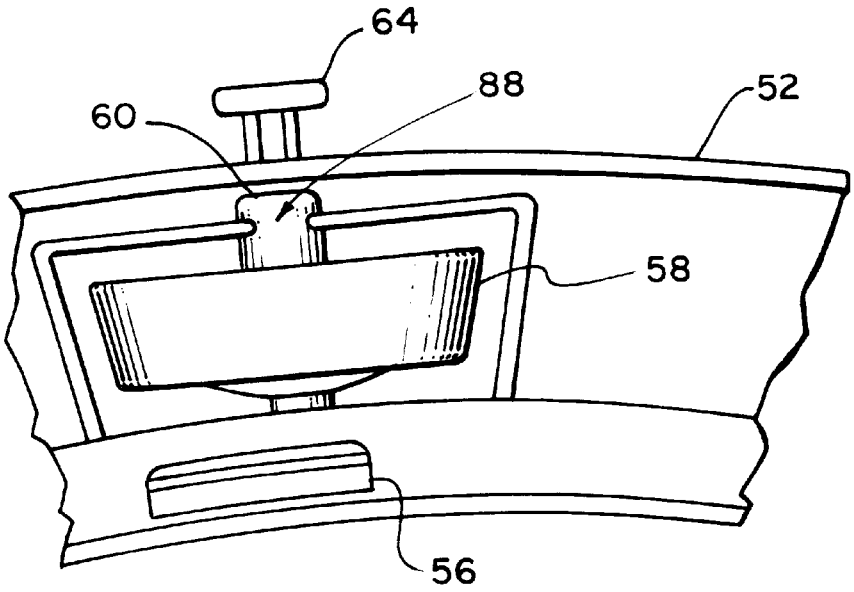
FIG. 12 is a fragmentary view of a seat frame roller, as seen from vantage 12—12 in FIG. 5.

Rollers 58, mounted to the periphery of frame 52 through integrally molded axles 60, roll against the upper surface of top 12, enabling the assembled seat to rotate within the furniture. The outboard ends of the wheel axles snap into slots 88 in the frame for assembly, as shown in FIG. 12. The inboard ends pivot within holes 61 in the frame. Referring to FIG. 9, the wheels are slightly tapered (have a frustoconical shape), the axis of wheel rotation is cambered inboard, and the upper surface of top 12 is tapered to match the taper of the wheels. The wheels are thus configured to roll in a circular path without skidding, thereby reducing wear and providing a centering force for the frame.

Figure 8:
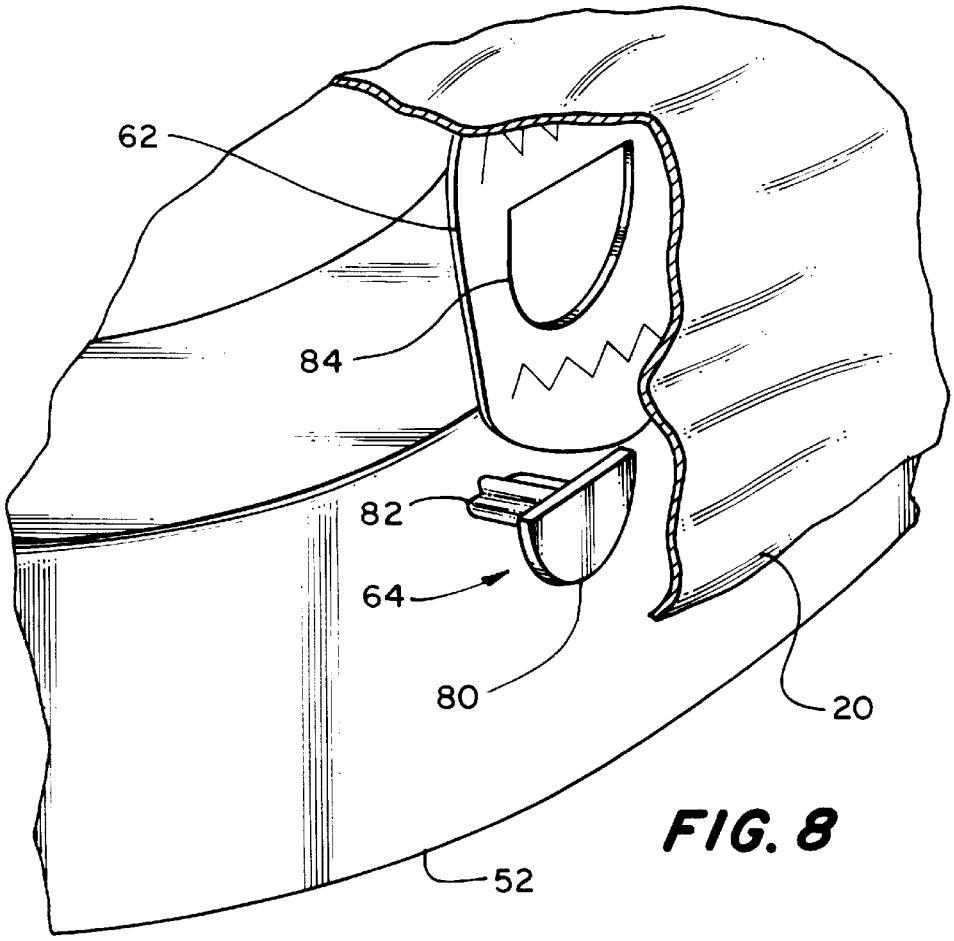
FIG. 8 is an enlarged fragmentary view of detail of the attachment features of the seat sling.

Frame 52 has a molded back portion 78 to provide additional support to the child's upper back. Fabric sling 20 attaches at several locations to frame 52 with plastic clips 62 that engage molded projections 64 around frame 52. As seen in FIG. 8, projections 64 have outwardly facing D-shaped knobs 80 molded on stems 82. Corresponding D-shaped holes 84 in clips 62 allow the projections to pass through the clips, so that the weight of the child in the sling is at least partially carried by load applied to the projections by the clips. Clips 62 are sewn into sling 20 to provide secure attachment, and are placed over projections 64 with the upper edge of sling 20 folded outward to cover the clips and projections.

Fabric sling 20 is preferably made of resin treated polyester fiber. Major portions of base 10, top 12 and supports 14 are injection molded polypropylene, with caps 40 and rocker pads 33 a wear-resistant, semi-resilient moldable polyvinyl chloride (PVC). Buttons 28 are molded ABS for strength.

Other embodiments will occur to those skilled in the art and are within the scope of the claims.

What is claimed is:

1. Convertible child's furniture comprising:

a base;

laterally spaced apart supports connected to and extending upwardly from said base, said supports being vertically adjustable to adjust the height of said furniture; and a top having a child's seat suspended therefrom, said top extending between and removably connected to and supported in spaced relation to said base by said supports;

said base having a flat surface on a side thereof facing away from said top and said supports;

whereby upon removal of said top, said furniture can be inverted to permit the use of the flat surface of said base as a table surface supported by said laterally spaced supports and said furniture can be adjusted for height in either its original or inverted orientation.

2. The furniture of claim 1 in which the child's seat comprises a frame; and a flexible sling with a pair of holes to accept a child's legs, the sling being connected to said frame.

3. The furniture of claim 2 in which said sling is removably connected to said frame.

4. The furniture of claim 2 in which said frame is rotatably mounted to said top.

5. The furniture of claim 4 in which said top further comprises a lock to alternatively prohibit rotation of said frame within said top.

6. The furniture of claim 5 in which said lock comprises a slidable member of said frame, the slidable member constructed and arranged so as to engage at least one slot in an upstanding lip of said top.

7. The furniture of any one of claim 2, 3, 4, 5 or 6 in which springs are connected to the underside of said top, said springs resiliently vertically moveably supporting said top above said supports.

8. The furniture of claim 7 in which a sleeve is provided below said top, said sleeve removeably engaging said supports, said top supported by said springs on said sleeve.

9. The furniture of claim 1 in which two curved rockers extend downwardly along opposing edges of the flat surface of said base.

10. The furniture of claim 9 further comprising engageable stops to disallow rocking motion of the furniture in a forward direction, a rearward direction, or in both directions.

11. Convertible child's furniture comprising:

a base having a flat bottom surface with curved rockers extending downwardly along opposing edges of the flat surface of said base;

laterally spaced apart supports connected to and extending upwardly from said base, the supports being vertically adjustably mounted to said base to adjust the height of said furniture;

a top extending between and removably connected to and supported in spaced relation to said base by said supports, said top having springs connected to the underside thereof, said springs resiliently vertically moveably supporting said top above said supports, and said top having a child's seat suspended therefrom;

whereby upon removal of said top said furniture can be inverted to permit the use of the flat surface of said base as a table surface supported by said laterally spaced supports; and engageable stops on said bottom surface of said base to selectively disallow rocking motion of the furniture in a forward direction, a rearward direction, or in both directions.

12. The furniture of claim 11 in which the child's seat comprises:

a frame;

a flexible sling with a pair of holes to accept a child's legs, said sling being removably connected to said frame, said frame being rotatably mounted to said top; and a lock to selectively prohibit rotation of said frame within said top.

13. The furniture of either of claim 1 or 11 in which said base comprises support receivers connected to and extending upwardly from said base, said supports extending upwardly from said support receivers, said supports vertically moveable relative to said support receivers for adjustment of furniture height.

14. The furniture of claim 13 in which outwardly biased members are provided in ones of said supports and said support receivers and a series of vertically spaced openings, into which said members can extend, are provided in the others of said supports and said support receivers, whereby said supports may be selectively adjusted in height by moving said members to selected ones of said openings.

15. The furniture of claim 11 in which a sleeve is provided below said top, said sleeve removeably engaging said supports, said top supported by said springs on said sleeve.

16. The furniture of either of claim 1 or 11 in which said base on at least one side extending between said supports is uninterrupted by any structure extending away from said top beyond said flat surface.

* * * * *